US005480175A

United States Patent [19]

Astier et al.

[11] Patent Number: 5,480,175

[45] Date of Patent: Jan. 2, 1996

[54] INTERFACE DEVICE BETWEEN A SKI AND ASSOCIATED BINDINGS

[75] Inventors: Lionel Astier, Seynod; Joel Arduin, Metz-Tessy; Alain Bejean, Alby-Sur-Cheran, all of France

[73] Assignee: Salomon S.A., Chavanod, France

[21] Appl. No.: 45,119

[22] Filed: Apr. 12, 1993

[30] Foreign Application Priority Data

Apr. 10, 1992 [FR] France ..... 92 04592

[51] Int. Cl.[6] ..... A63C 9/08

[52] U.S. Cl. ..... 280/607; 280/602; 280/617

[58] Field of Search ..... 280/602, 607, 280/616, 617, 618, 633, 634

[56] References Cited

U.S. PATENT DOCUMENTS 4,896,895 1/1990 Bettosini ..... 280/607

5,242,188 9/1993 Bigler et al. ..... 280/607

FOREIGN PATENT DOCUMENTS

0437172A1 1/1990 European Pat. Off. .

PCT/CH83/00039 10/1983 WIPO .

*Primary Examiner*—Richard M. Camby

*Attorney, Agent, or Firm*—Pollock, Vande Sande & Priddy

[57] ABSTRACT

An interface device between a ski and front and rear bindings (2, 3) designed to hold the ends of a boot in place on the ski. The device comprises a plate (13) with an elongated the central part (14) which extends above the upper surface of the ski in the area of the runner. A first end (15) of the plate is fastened to the ski, and a second end (16) is attached to the ski by a block of damping material (17) mounted in a sandwich configuration between the end of the plate and the ski. The block of damping material is preferably provided in order to function under compression and shearing action.

11 Claims, 9 Drawing Sheets

INTERFACE DEVICE BETWEEN A SKI AND ASSOCIATED BINDINGS

FIELD OF THE INVENTION

The invention relates to an interface device between a ski and front and rear bindings which is designed to hold a boot supported on a ski.

BACKGROUND OF THE INVENTION

The skis used for alpine skiing are constituted by relatively long boards on which the skier's boots are held in place by a front and a rear binding. The boots and bindings are positioned in the central zone of the ski, commonly called the runner.

It is known that, when the bindings are assembled directly to the ski, the sole of the boot exerts a stiffening action on the ski, in the area of the runner. Moreover, the bindings exert a clamping action on the boot sole, the reaction to which is transmitted to the ski.

The flection of skis of this type is, therefore, affected by the boot and the bindings.

Some binding assemblies have been designed so as to weaken to the maximum possible extent the disruptions of ski flection caused by the boot. A binding assembly of this type is, for example, disclosed in DE-OS 3 109 754.

There are also other devices which, resist ski flection either by exerting a stiffening action, or by a damping action in the runner zone, or by a combined stiffening and damping action. A device of this kind, described, for example, in EP 104 185, comprises a plate supporting the front and rear bindings and comprising a central part which is raised in relation to the upper ski surface and one end of which is attached to the ski, while the other end is connected to the ski while allowing relative longitudinal movement. Elastically-deformable blocks exert a damping action on this longitudinal movement. Furthermore, this device comprises a layer of elastically-deformable material inserted between the central portion of the plate and the upper ski surface.

This device effectively damps the flection movements of the ski, but it exerts little or no action on the vibrations to which the ski is subjected. These vibrations impair contact between the sole of the ski and the snow, and, accordingly, if these vibrations are not damped, the speed of the ski and the precision with which it is guided will not be optimal.

SUMMARY OF THE INVENTION

One object of the present invention consists in proposing an interface device which damps ski flection and the vibrations generated on the ski, in particular the vibrations which can cause a resonance phenomenon in the front portion of the ski.

Another purpose of the present invention is to object a simple interface device which can be easily adapted on a ski.

Another object of the present invention is an interface device which allows the ski to be guided with a high degree of precision.

Other objects and advantages of the present invention will emerge from the following description.

The interface device is positioned between a ski and front and rear bindings, which are designed to hold the ends of a boot in place, the bindings being connected to the ski in the area of the runner. The device comprises a plate, of which a longitudinal central portion extends above the upper surface of the ski, above the runner area. A first end of the plate is attached to the ski, and the second end is connected to the ski so as to allow relative movement in relation to the ski during its movements of flection, at least one of the bindings being assembled to the plate.

The device is characterized by the fact that the second end of the plate is attached to the ski using a block made of a damping material mounted in a sandwich configuration between the second end of the plate and the upper ski surface.

BRIEF DESCRIPTION OF THE DRAWINGS

The invention will be better understood with reference to the description below and to the attached drawings which form an integral part of it.

DESCRIPTION OF THE PREFERRED EMBODIMENTS

Figure 1:
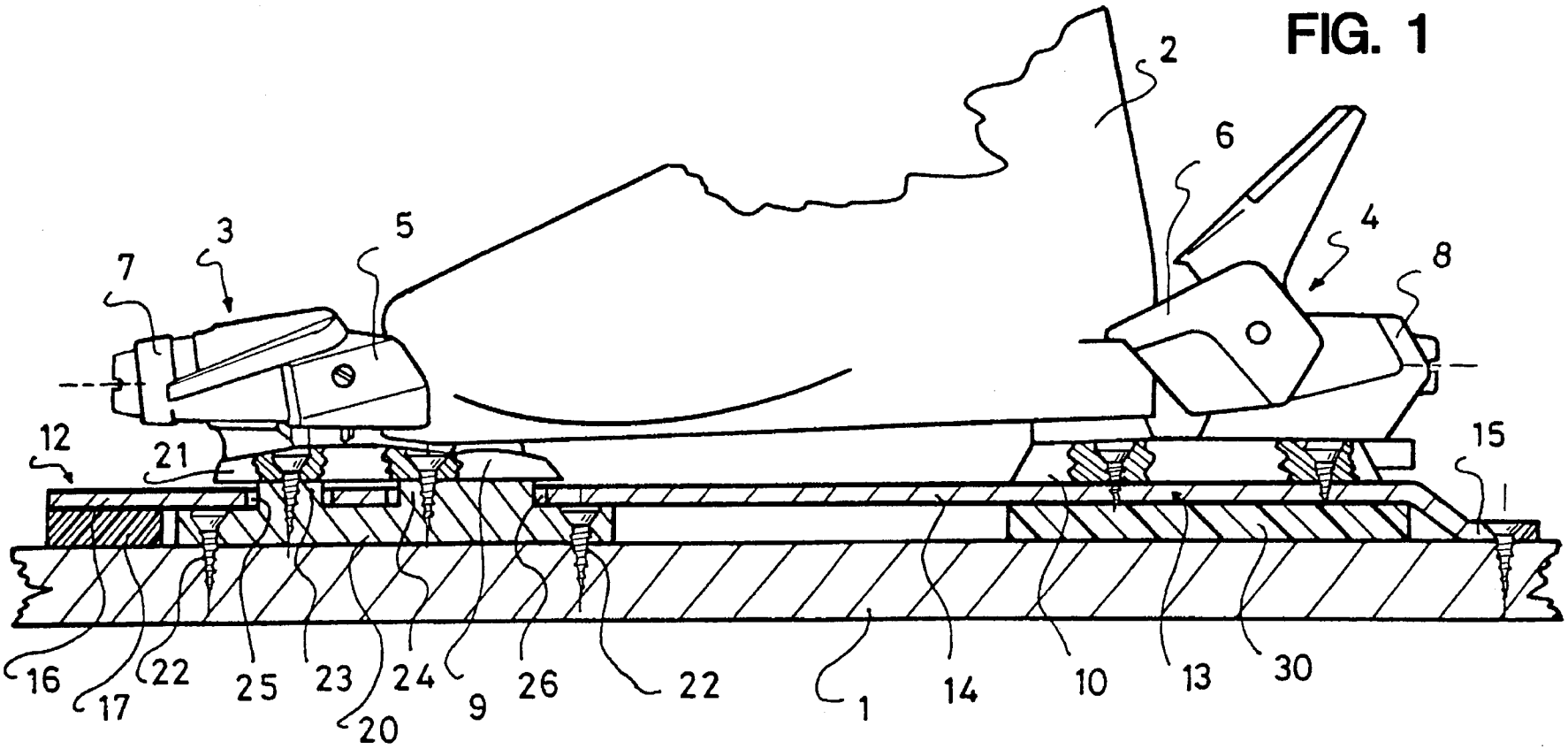
FIG. 1 is a schematic side view, in partial cross-section, of a ski equipped with an interface device according to a first embodiment of the invention.

FIG. 1 is a schematic representation of the central area of a ski 1, commonly called the runner. This figure also shows a boot 2 whose front and rear ends are held in place on the ski by a front binding 3 and a rear binding 4, respectively. The two bindings are of any suitable type. In conventional fashion, the front binding 3 incorporates a device 5 for holding the front end of the boot in position, a body 7, and a support plate 9 on which rests the front end of the sole of the boot. In parallel fashion, the rear binding 4 incorporates a position-retention device 6, a body 8, and a support plate 10 holding the rear end of the boot sole.

The front and rear bindings 3 and 4 are connected to the ski by means of an interface device 12, which will now be described in greater detail.

The interface device 12 comprises mainly a longitudinal connection plate 13 extending above the ski, in the area of the runner. The plate 13 is made of any suitable material, e.g., a metal alloy; it could also be made of a synthetic or composite material. The plate possesses a high degree of resistance to longitudinal compression stresses, as well as flective and torsional stresses.

The longilinear connection plate 13 has a central portion 14 which is raised in relation to the upper ski surface. At least one of the bindings is assembled to the central part 14 of the plate 13. In the example illustrated, it is the rear binding 4 which is assembled to the ski using any appropriate means, e.g., screws.

The plate 13 further comprises a rear end 15 located to the rear of the rear binding 4, which is attached to the ski by means of any suitable means, e.g., screws.

The connection plate 13 comprises a front end 16 which, in the example shown, extends beyond the front binding 3. The front end 16 of the plate is elevated in relation to the upper surface of the ski, and, in this area, a block of elastically-deformable material 17 connects the plate 16 to the ski. The block of material 17 has, for example, the shape of a parallelepiped, and its upper and lower faces are attached to the plate 16 and to the ski using any suitable means, e.g., by adhesive bonding. The material 17 is thus mounted in a sandwich configuration between the plate 16 and the ski.

The material composing the block 17 is of any suitable nature; however, a material is chosen which can function under the effect of shearing, at least along the longitudinal line determined by the ski, and under the effect of damping in a vertical direction. The damping material 17 is, in fact, stressed in two different ways. During flection of the ski, the front end of the plate 13 tends to move forward in relation to the ski, since its rear end 15 is attached to the ski. This relative movement stresses the block of material 17 under shearing action, and the flective movements of the ski are thus damped. The block is also stressed by flective movements generated by the front end of the ski, i.e., those movements generated in front of the front binding 3. The block 17 is thus stressed under compression, in a vertical direction.

It must be added that, when the block 17 is stressed by the plate under shearing action and by reaction, the front of the ski is subjected to a moment tending to cause the tip to be inclined toward the snow.

It has been noted that the arrangement of the block 17 mounted in a sandwich configuration between the front end of the plate 16 and the ski effectively damps what is customarily termed the first mode of flection of the ski, or the flection insole of the ski, i.e., the vibrations in the front portion of the ski, for which the front binding forms a node, and the ski tip forms an underside.

Good results were obtained by using a block 17 whose length ranged between 50 and 300 millimeters, and preferably approximately 150 millimeters. The thickness of the block is preferably greater than 5 millimeters.

The material used is, for example, rubber or a polyurethane elastomer. A commercial material known by a trade name "Sorbotane" yields good results.

Nevertheless, the value of theses figures and information is not restrictive as regards the invention.

The block 17 can also be replaced by a rigid support surmounted by a layer of bonding agent which has the property of functioning under shearing, i.e., a bonding agent which stretches when acted upon by a shearing stress, while resisting this deformation. This layer would have a thickness of approximately 2 millimeters.

In the embodiments shown in the drawings, the front binding 3 is assembled not to the plate 13, but to the ski 1 by means of a block 20. The spacer 20 raises the front binding 3 and ensures, in this area, direct transmission of the stresses between the ski and the boot.

As shown in FIG. 1, the spacer 20 extends beneath the base 21 of the binding and is attached to the ski using any suitable means, e.g., screws 22. The upper part of spacer 20 incorporates part, studs 23, 24 which pass through the thickness of the plate 13, and on which the base 13 of the binding comes to rest. The thickness of the spacer 20 is equal to, or slightly less than, the height to which the plate is raised in this area, in relation to the ski.

The height of the studs 2.3 and 24 is greater than the thickness of the plate, and the plate incorporates openings in the area of the studs, so that the front part of the plate can slide freely in relation to the block during flective movements of the ski.

The base 21 of the front binding 3 rests on studs 23, 24, and, in the embodiment shown, it is assembled to these studs using screws.

Figure 2:
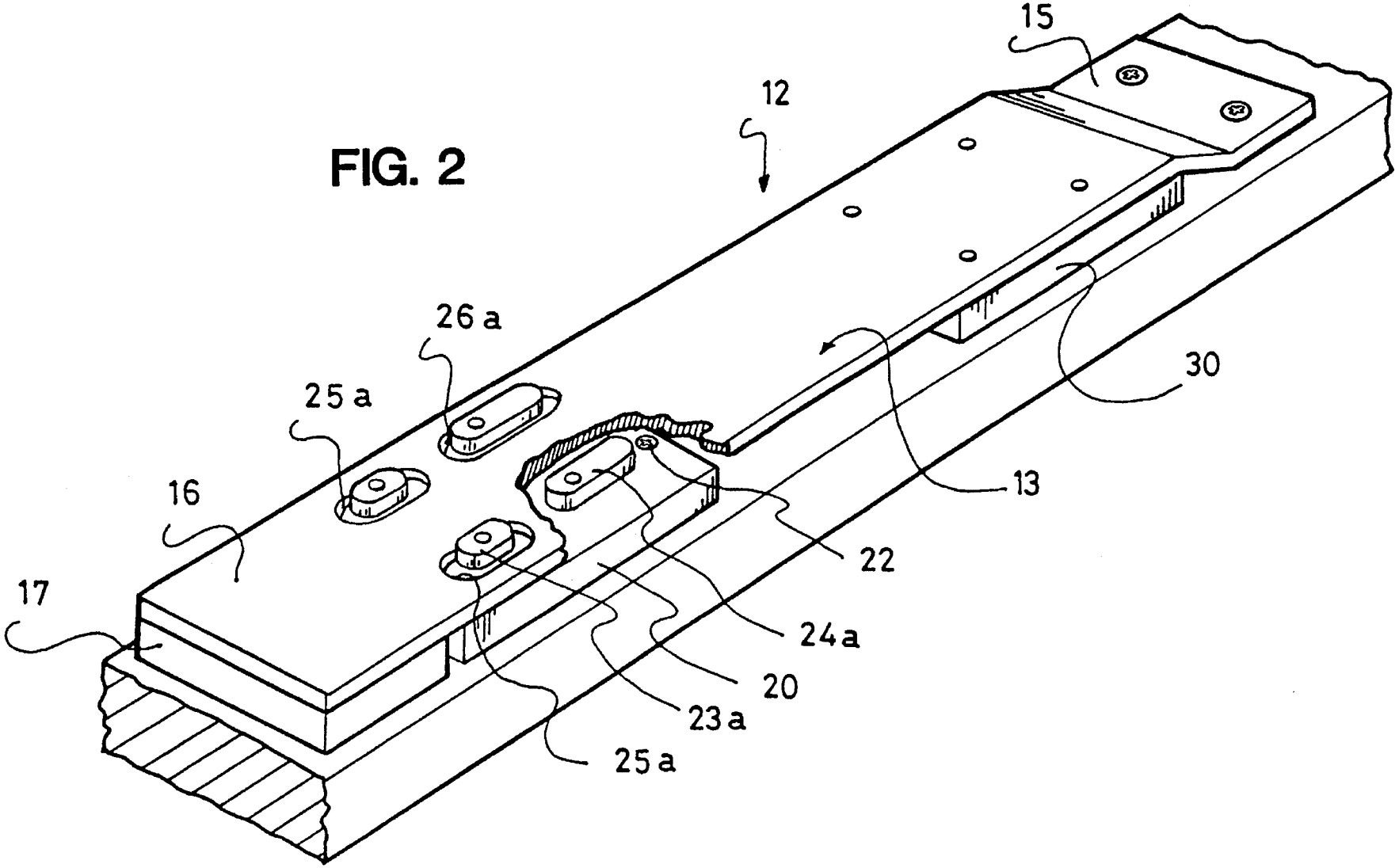
FIG. 2 is a perspective partial cross-section of the interface device in FIG. 1.

FIG. 2 illustrates a first embodiment of this assembly using chimney-shaped studs 23*a* and 24*a* which pass through slot-shaped openings 25*a*, 26*a* arranged longitudinally in the plate 13. In the longitudinal dimension, the length of the openings 23*a* to 26*a* is greater than that of the studs 23 to 26. The space between the studs and the contour of the openings is filled with an elastically-deformable material, e.g., a damping material.

Figure 3:
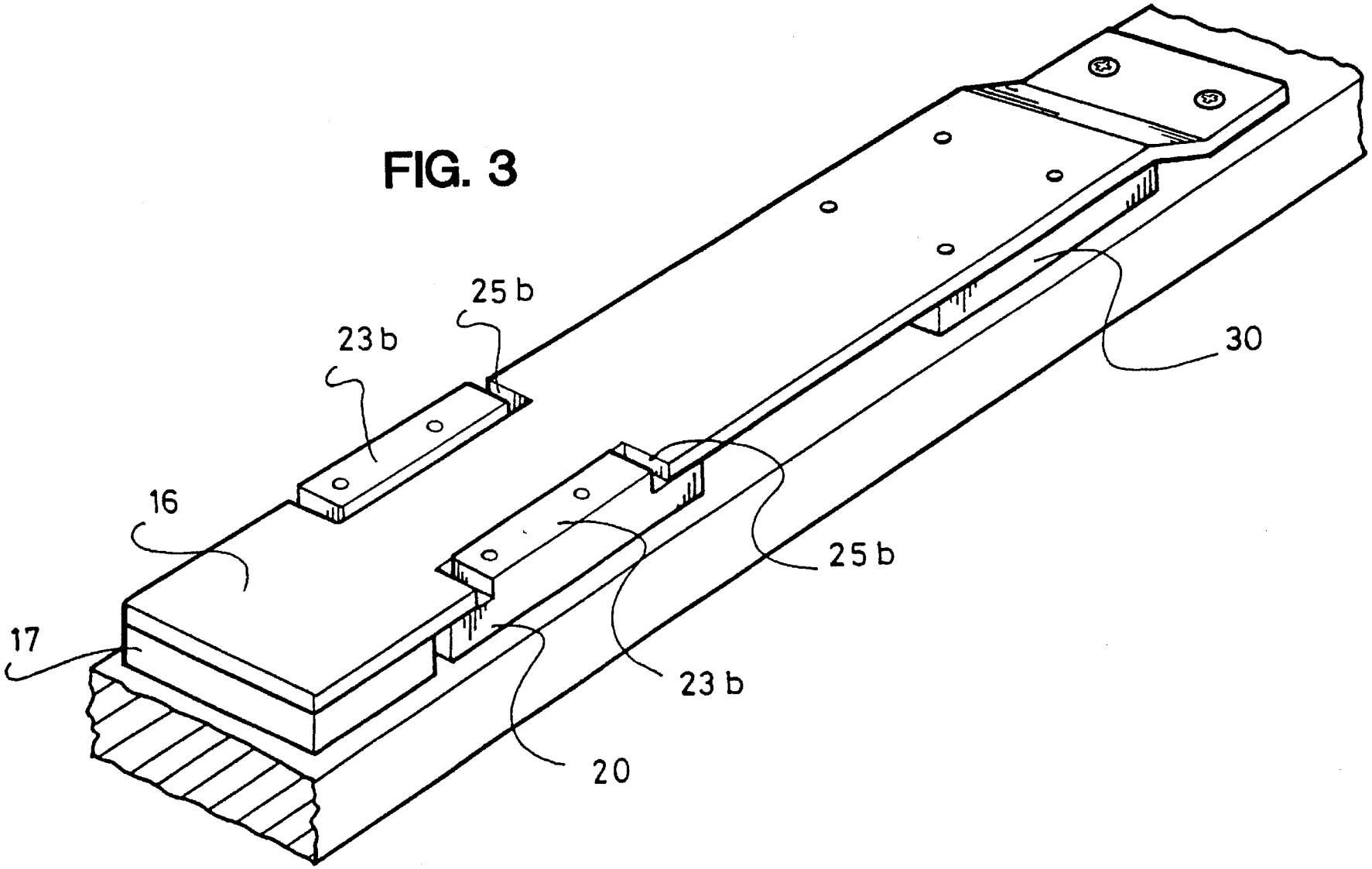
FIG. 3 is a perspective view of a variant of the interface device.

FIG. 3 represents a variant, in which the front block 20 has lateral studs 23*b* which pass through the plate at the site of the lateral, notch-shaped opening 25*b*.

The studs preferably extend at least within the zones of the base 21 in which the screws used to assemble the binding to the ski are positioned; preferably, they also extend toward the rear of the binding, so as to support, at least in part, the binding-support plate 9.

Moreover, the studs belonging to the spacer 20 preferably are long enough so that the front binding 3 can be mounted in a position which is adjustable, depending an the length of the skier's boot.

According to one variant, the studs constitute, for the plate, a forward-motion stop, so as to protect the block 17 in the event of excessive flection of the ski. In this event, the plate comes to be supported directly on the studs, after determinate flection of the ski.

According to another embodiment, the studs play act as a guide in the longitudinal motion of the plate; i.e., their transverse dimension is modified with respect to the transverse dimensions of the plate and of its openings at this point, in order to impede any transverse movement of the plate. FIG. 3 illustrates this kind of adjustment.

According to another variant, blocks of damping material are inserted between the studs 23 and 24 and the plate, in the area of the openings 25, 26, to produce a longitudinal damping effect.

FIGS. 1 to 3 show a block made of an elastically-compressible material 30, which extends between the rear portion of the central part 14 of the plate and the upper ski surface. The block of material 30 preferably possesses damping properties and extends at least beneath the rear binding 4. The function of this block is to damp vertical stresses between the boot and the ski in this area, and, in particular, the stresses caused by flection of the plate 13 or by flection of the ski 1 at this point.

Figure 4:
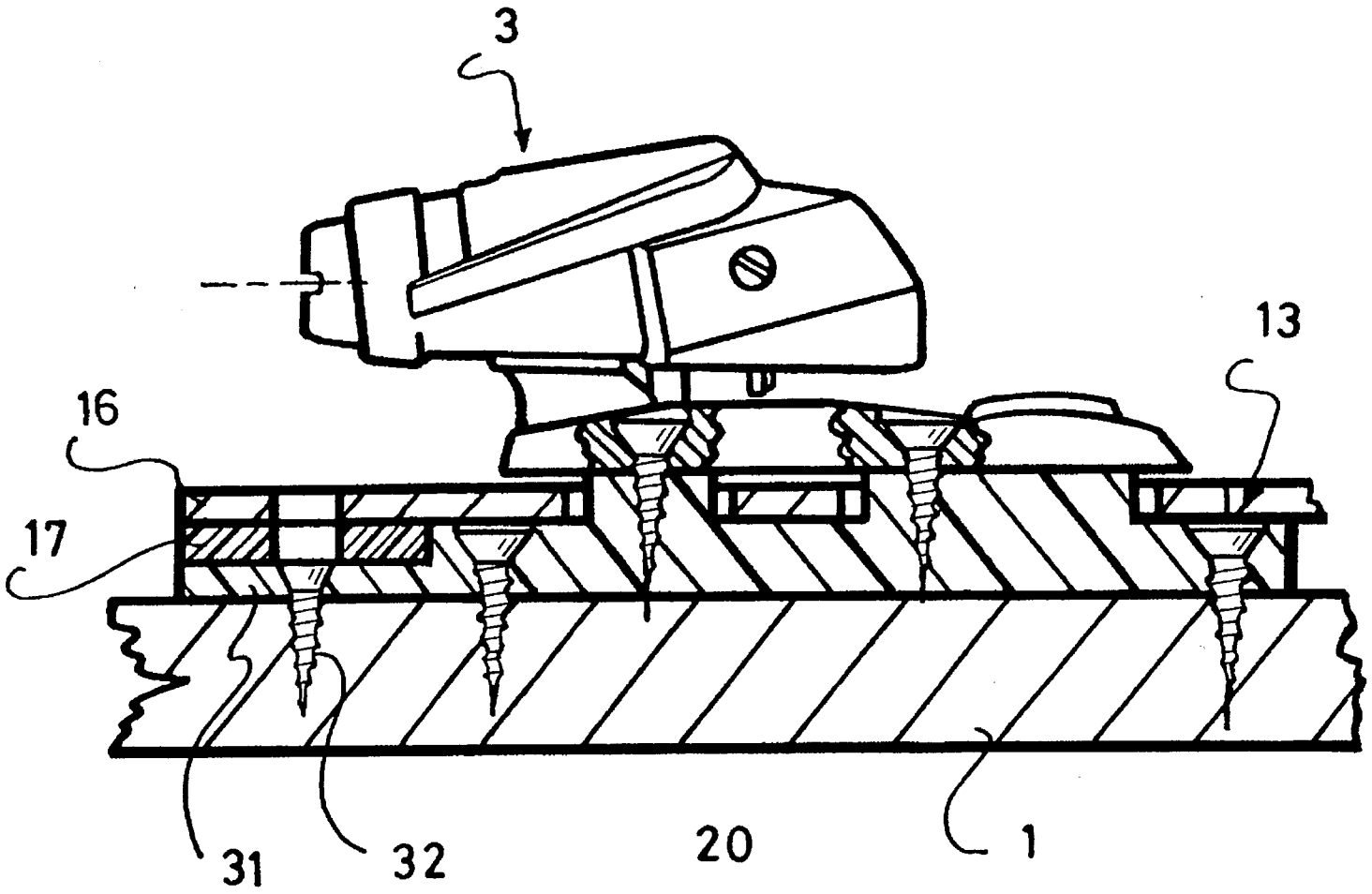
FIG. 4 illustrates, in a side view in partial crosssection, a variant of the device in FIG. 1.

FIG. 4 shows a variant of the front part of the interface device. In accordance with this variant, the spacer 20 is extended forward by a tongue 31 extending beneath the front end 16 of the plate. The block of damping material 17 is then mounted in a sandwich configuration between the plate and the tongue 31. As may potentially be desired, attachment of the spacer 20 to the ski can be strengthened in the area of the tongue 31 by means of screws 32. This arrangement makes it possible to avoid adhesive bonding of the damping block 17 to the upper ski surface, an operation which often proves difficult. In addition, because of this arrangement, it is possible to detach the interface device easily and without damage.

Figure 5:
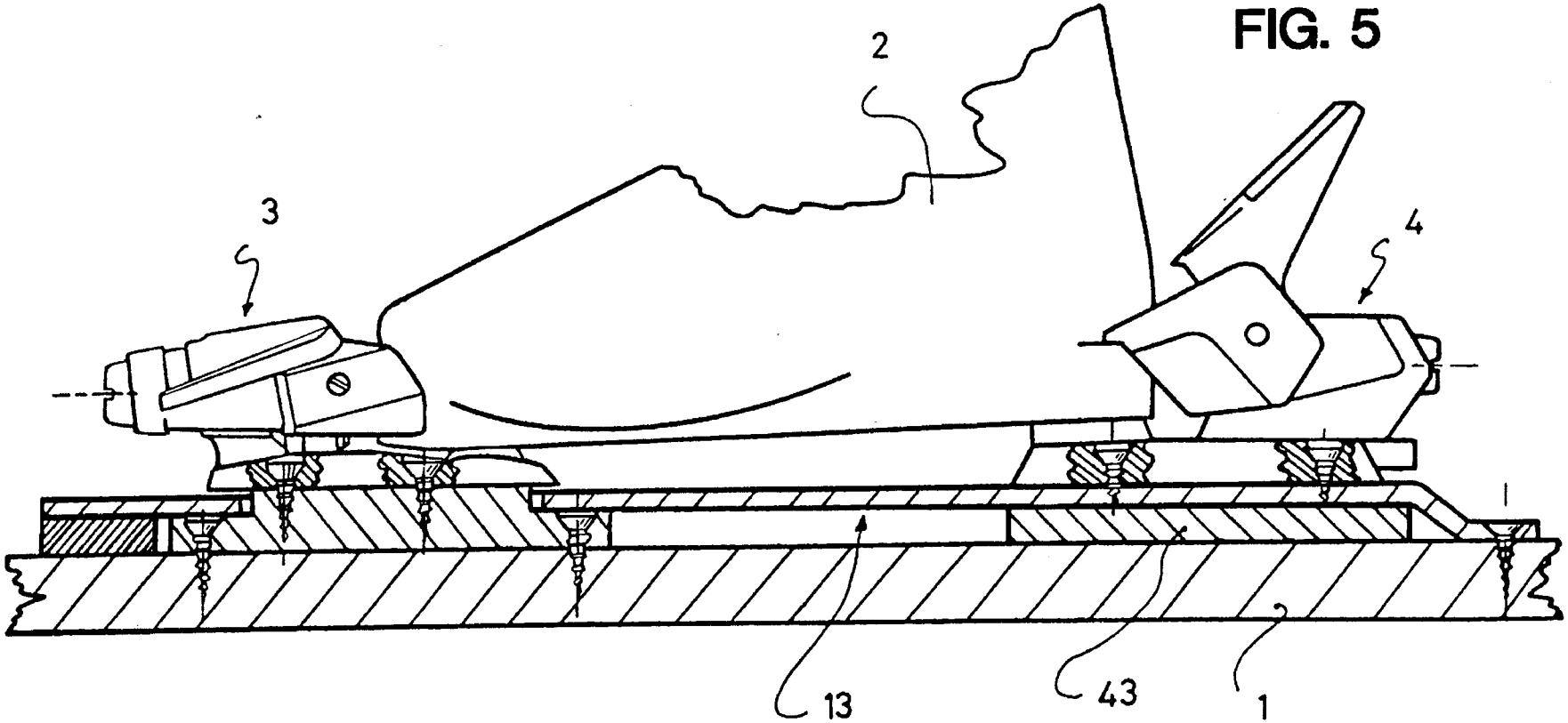
FIGS. 5, 6 and 7 show other correspond to variants.
Figure 6:
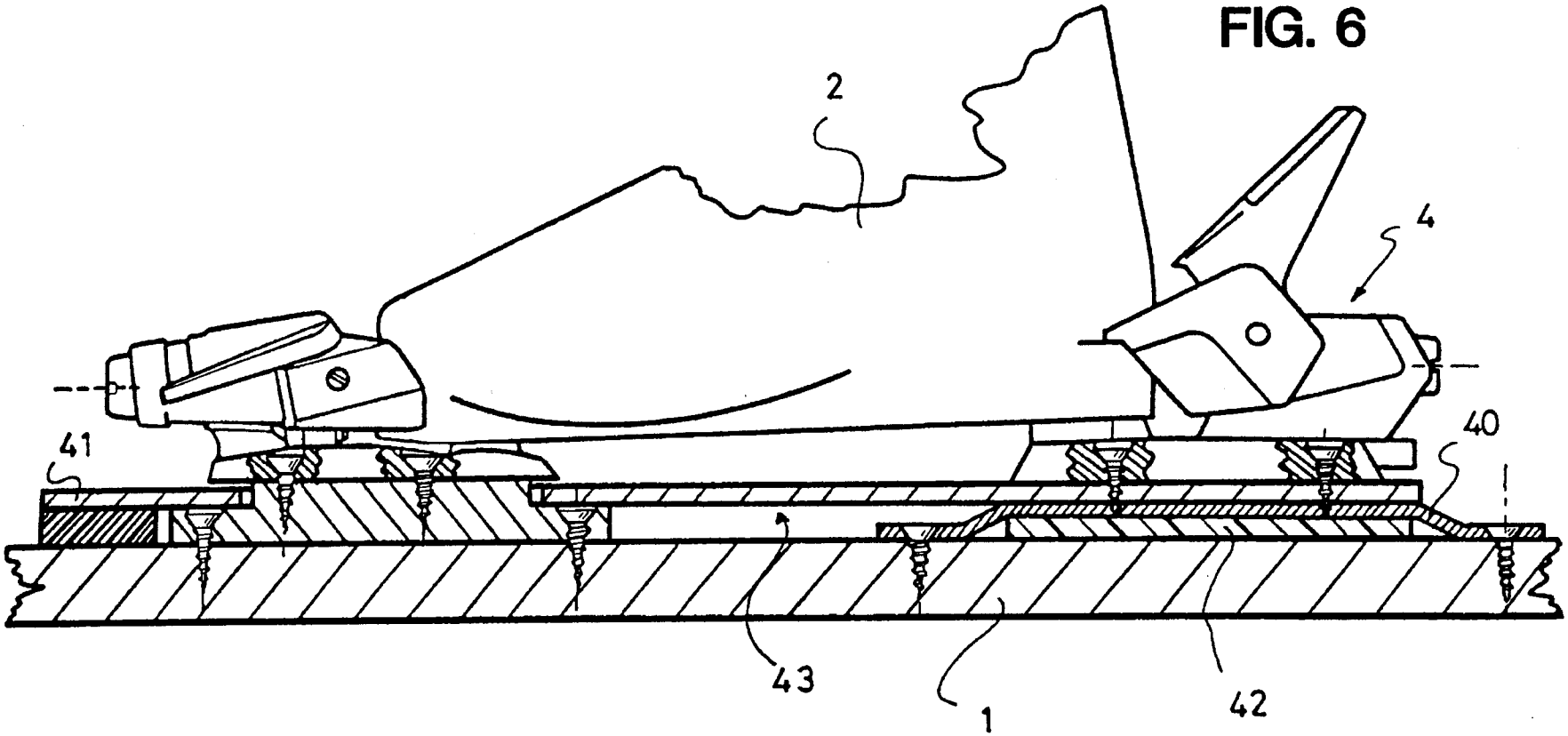

FIGS. 5 and 6 illustrate variants of the device in the area of the rear binding.

The construction in FIG. 5 is similar to that described with reference to FIG. 1, except that the block of damping material 30 located beneath the rear binding 4 is here replaced by a rigid block 43 positioned between the plate 13 and the upper surface of the ski. This block 43 provides for a direct connection between the rear binding 4 and the upper ski surface.

FIG. 6 illustrates a plate 43 made of two elements, a first element 40 located in the area of the rear binding 4, and a platform 41 attached to the rear portion of this element 40 and extending beneath the upper ski surface until it reaches a point beyond the front binding. Seen from the side, the element 40 has the form of an upper-case omega having a front and a rear part attached to the ski in the zones located in front and in back of the rear binding 4, and a median portion raised in relation to the upper ski surface, and to which, the plate 41 is connected. A block of elastically-deformable material 42 is located between this zone and the upper surface ski. This construction allows more direct support between the rear support plate 10 and the ski.

Figure 7:
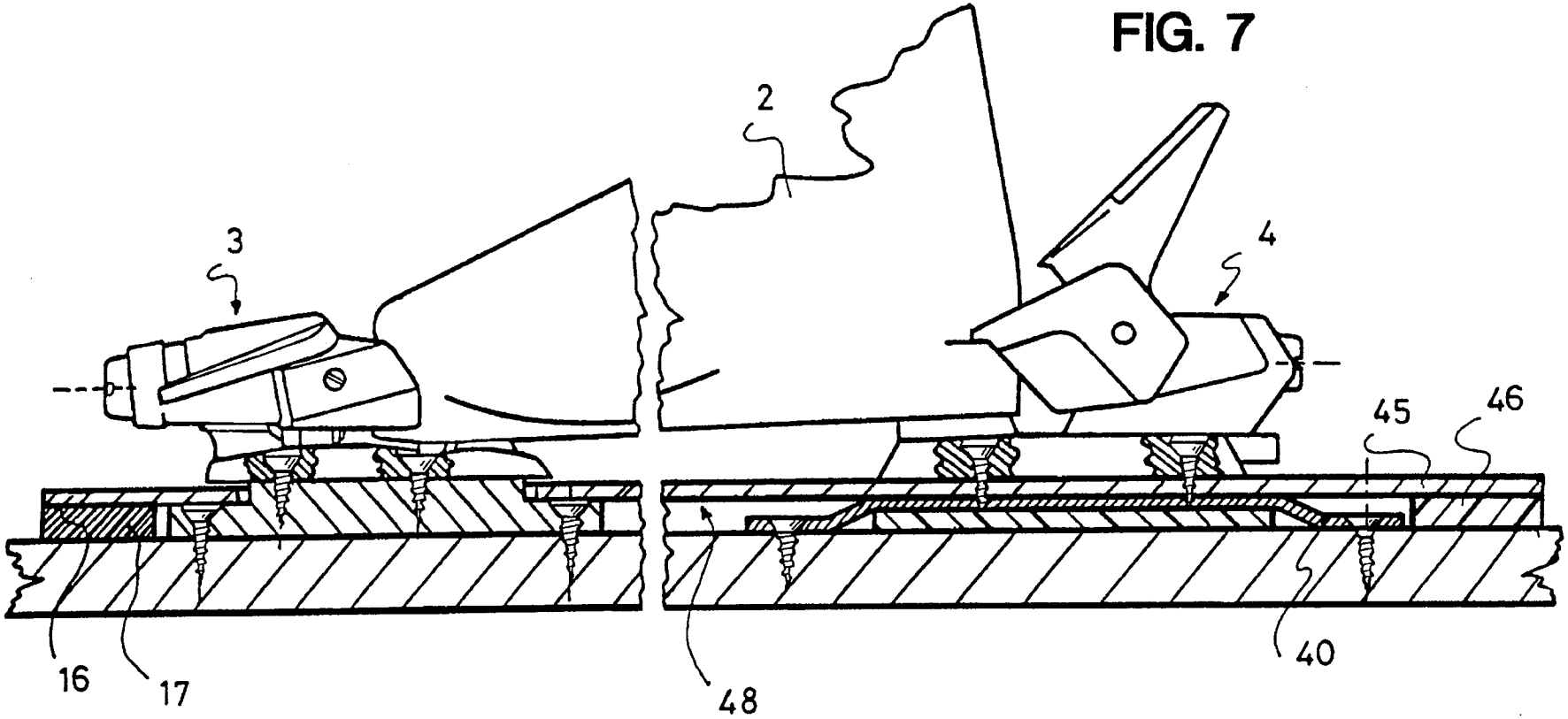

FIG. 7 illustrates a variant of the embodiment of FIG. 6. In this variant, the plate 48 extends rearward and beyond the element 40, where it has an end 45 raised in relation to the upper ski surface. A block of-elastically-deformable material 46 is mounted in a sandwich configuration between the end 45 of the plate and the upper ski surface. This block has vertically-directed damping properties. Its purpose is to damp the vibrations in the rear end of the ski, especially those whose frequency matches the first mode of flection of the rear part of the ski.

Figure 8:
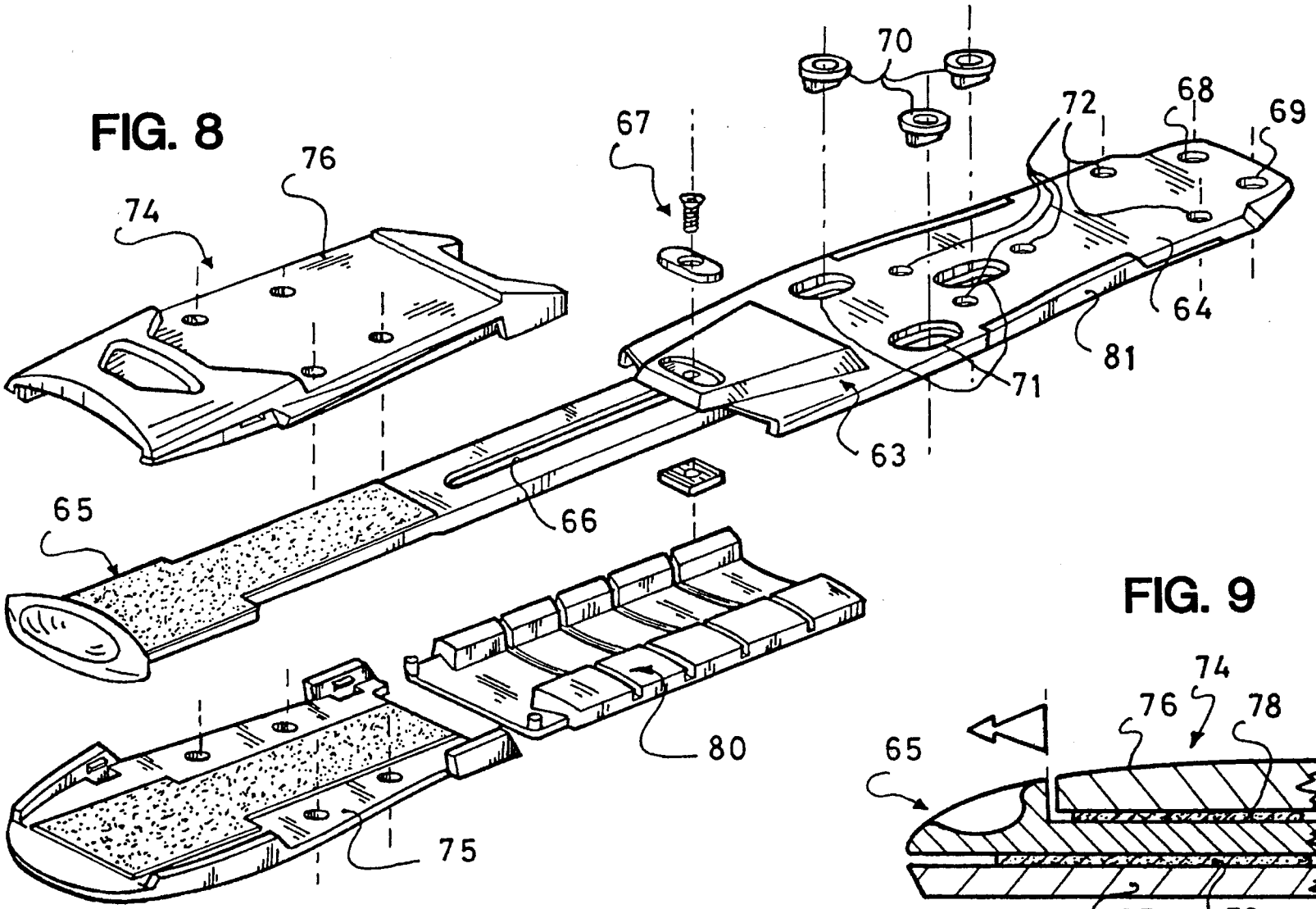
FIG. 8 illustrates another variant.

FIG. 8 illustrates another embodiment, in which a plate 63 is constituted by two components assembled together, i.e., a rear component 64 and a front component 65. In the area of its connection to the rear component 65, the component 65 incorporates a longitudinal slot 66. The component 64 is, moreover, equipped with a screw/nut device 67. In this way, the two components can slide in each other and can be tightly assembled using the screw/nut system 67. The total length of the plate 63 can thus be made to vary.

The rear component 64 is tightly attached to the rear portion of the ski by screws inserted in the recesses 68 and 69. In the central part of the rear component 64, three shouldered washers 70 lodged in three orifices 71 are preferably provided. The washers 70 are intended to be attached to the ski by screws, and the orifices 71 are, longitudinally slightly longer than the washers 70, in order to permit slight relative movement in a longitudinal direction. The main function of the shouldered washers 70 is to keep the central part of the rear component 64 in proximity to the upper ski surface.

The rear component 64 also has holes 72 used to mount the rear binding. In this area, the rear component 64 is preferably raised in relation to the upper ski surface, and an interface layer 81 of elastically-deformable material is inserted between the rear component 64 and the upper ski surface. This layer provides vertical damping of the rear support of the boot.

The block 64 on which the front binding rests is constituted, in the example illustrated, by two superposed elements, namely a lower element 75 and an upper element 76. When these two elements are mounted on one another, they delimit a longitudinal opening which passes through the front portion of the front component 65.

The upper surface 76 incorporates, upper part, a surface supporting the front binding. Furthermore, in the example shown, the screws used to assemble the front binding pass completely through the upper part 76 and the lower part 75 of the spacer 74, thus tightly attaching this assembly to the ski.

The front component 65 thus has, in its front part, a kind of elongated tongue which passes completely through the spacer 74 longitudinally.

Figure 9:
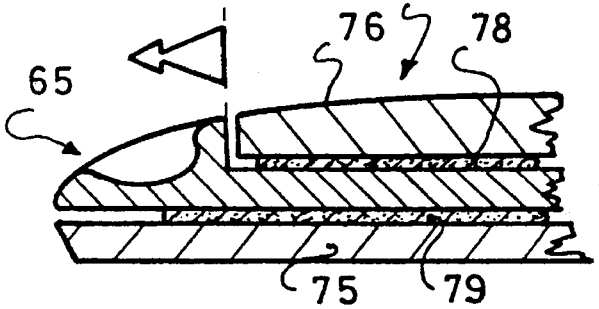
FIG. 9 represents a detail of the embodiment in FIG. 8.

As shown in FIG. 9, the front component 65 is connected to the upper and lower parts of the spacer 74 by means of two layers of glue 78, 79. The glue used here has the property of functioning under shearing action, elastically resisting a deformation of this kind. Accordingly, the glue layers 78 and 79 make possible a relative longitudinal movement between the front component 65 and the block 64. This relative movement can have an amplitude of approximately five millimeters toward the front, and the glues layers, by stretching under the effect of shearing, resist this movement.

The device illustrated in FIG. 8 also has a cradle 80 which is connected to the upper part 76 of the spacer 74. The cradle 80 guides the front component 65 belonging to the plate 63 to the rear of the spacer 74. As shown in FIG. 8, the cradle 80 is made of a series of divisible elements, which are cut depending on the total length which it is desired to give to the plate 63. This length is determined based on the spacing between the front and rear bindings, and thus, on the length of the boot.

During skiing, a relative movement occurs between the front part of the plate 63 and the spacer 74. The glue layers 78 and 79 are then stressed under shearing and resist this relative movement.

Figure 10:
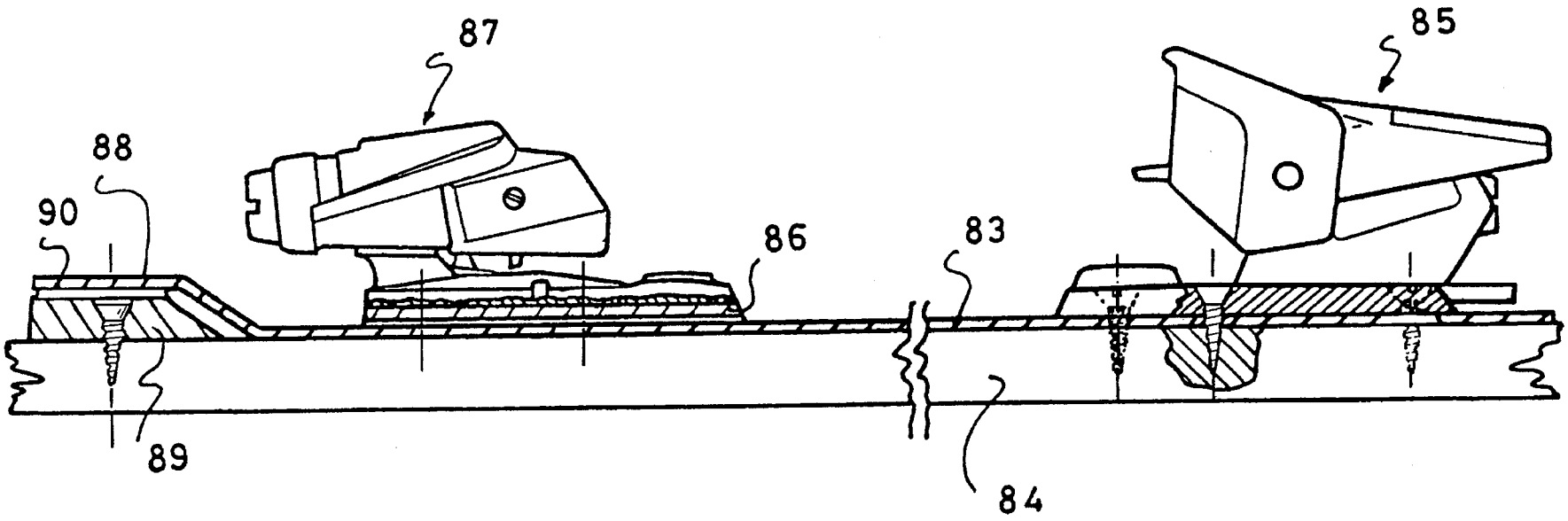
FIG. 10 illustrates another variant.

FIG. 10 illustrates schematically another embodiment, in which the plate 83 extends against the upper ski surface 84 over the greater portion of its length. The rear part of the plate 83 is assembled to the ski by clamping it between the ski and the base of the rear binding 85. In its front part, the plate 83 passes freely through a block 86 to which the front binding 87 is assembled. The block 86 is assembled to the ski so as to form one piece, and the plate 83 can slide freely in this area in a longitudinal direction.

In front of the front binding 87, the plate 83 incorporates a raised part 88, which is assembled to a support 89 by means of a glue layer of the same type as that used in the preceding variant.

During skiing, a relative longitudinal movement occurs between the raised part 88 of the plate 83 and the support 89 tightly attached to the ski. This relative longitudinal motion is opposed by the glue layer 90, which works under shearing action.

The positioning of the plates 13, 48, 63, 83 and the base of the bindings could be reversed, so that the front binding would be connected to the plate, and the rear binding tightly attached to the ski using a block. In this case, the block of elastically-deformable material 17 could be positioned beyond the rear binding, and, as required, a block of elastically-deformable material of the same type as the block 46 could be positioned beyond the rear binding.

What is claimed is:

1. Interface device between a ski and front and rear bindings designed to hold the ends of a boot in place, said bindings being connected to a central area of said ski, said interface device comprising a spacer attached to said ski and assembled to one of said bindings, and a connection plate assembled to the other of said bindings, said connection plate having a first end fastened to said ski, a central part raised in relation to an upper surface of said ski, and a second end attached to said ski beyond said spacer, by means of a first block of damping material mounted in a sandwich configuration between an end of said connection plate and said ski.

2. Device according to claim 1, wherein said block of damping material is mounted in a sandwich configuration between said second end of said plate and said upper surface of said ski.

3. Device according to claim 2, wherein a second block of an elastically-compressible material (30) is inserted between said plate (14) and said ski (1), at least in the area in which said second binding is assembled to said plate.

4. Device according to claim 3, wherein said second binding (4) is carried by an element (40) having front and rear ends fastened to the ski in front and in back of a damping block (42) positioned beneath said second binding.

5. Device according to claim 2, wherein said connection plate (13) extends above said spacer (20) and said spacer incorporates means (23, 24) for supporting said first binding (3) which pass freely through an entire thickness of said plate and which permit freedom of movement of said plate in a longitudinal direction in relation to said spacer.

6. Device according to claim 4, wherein said support means are chimney-shaped studs (23*a*, 24*a*) belonging to said spacer, said studs passing through the thickness of said plate 914) in the area of longitudinally-positioned openings (25*a*, 26*a*).

7. Device according to claim 4, wherein said support means are longitudinal lateral studs (23*b*) which pass through the thickness of the plate in the area of longitudinal notches (25*b*) arranged laterally in said plate.

8. Device according to claim 2, wherein said spacer (20) is extended by a tongue (31) on a side opposite said second binding, and said first block of damping material (17) is mounted in a sandwich configuration between said end (16) of said plate and said tongue (31).

9. Device according to claim 1, wherein a first face of said first block of damping material (17) is glued to said plate (14), and a second face of said first block is glued to said ski (1) or to said tongue (31).

10. Device according to claim 2, wherein said spacer (74) is provided with a longitudinal opening which passes through the front part of said plate (63), and said layers of damping material (78, 79) connect the upper and lower faces of said plate (63) to said spacer (74).

11. Device according to claim 1, wherein said plate (63) has at least one oblong orifice (71) for receiving a shouldered washer (70) fastened to said ski.

* * * * *